US006176971B1

(12) United States Patent
Sun Yu et al.

(10) Patent No.: US 6,176,971 B1
(45) Date of Patent: Jan. 23, 2001

(54) HEAT ECONOMY ENHANCEMENTS FOR THE RECOVERY AND USE OF ENERGY OBTAINED FROM SPENT COOKING LIQUORS

(75) Inventors: Ella Sun Yu, Singapore (SG); C. Bertil Stromberg, Glens Falls, NY (US); Rolf C. Ryham, Suwanee, GA (US); R. Fred Chasse, Stratham, NH (US)

(73) Assignee: Andritz-Ahlstrom Inc., Glens Falls, NY (US)

( * ) Notice: Under 35 U.S.C. 154(b), the term of this patent shall be extended for 0 days.

(21) Appl. No.: 09/195,444

(22) Filed: Nov. 18, 1998

(51) Int. Cl.[7] ..... D21C 11/00
(52) U.S. Cl. ..... 162/29; 162/47; 162/250
(58) Field of Search ..... 162/23, 29, 46, 162/47, 261, 250

(56) References Cited

U.S. PATENT DOCUMENTS 4,668,341 5/1987 Nilsson ..... 162/23

FOREIGN PATENT DOCUMENTS

WO96/32531 10/1996 (WO) .
WO97/29236 8/1997 (WO) .

*Primary Examiner*—Dean T. Nguyen
(74) *Attorney, Agent, or Firm*—Nixon & Vanderhye P.C.

(57) ABSTRACT

Useable steam, e.g. substantially clean useable steam, is produced from a chemical cellulose pulping system hot spent treatment liquor (e.g. black liquor) with optimum energy efficiency by passing the spent liquor to a reboiler, and then pressurizing (e.g. with an eductor, fan, or compressor) the clean steam discharged from the reboiler. The clean steam can be used to steam incoming chips (e.g. in a chip bin) without significantly increasing the TRS load on the pulp mill NCG system.

20 Claims, 3 Drawing Sheets

HEAT ECONOMY ENHANCEMENTS FOR THE RECOVERY AND USE OF ENERGY OBTAINED FROM SPENT COOKING LIQUORS

BACKGROUND AND SUMMARY OF THE INVENTION

The processing of comminuted cellulosic fibrous material, for example, wood chips, to produce cellulose pulp is an energy-intensive process. Treatment temperatures greater than 100° C. and superatmospheric pressures are typical of most commercially-significant chemical treatments of cellulose, for example, the kraft process (also known as the sulfate process). What has made the kraft process so commercially successful is its inherent regeneration of energy from the combustion of waste cooking liquors and the regeneration of cooking chemical from the products of combustion through recausticization. However, due to the cost of energy in the late twentieth century, any further improvement to the energy efficiency of the chemical pulping process is welcome.

In published International application WO 96/32531 (the disclosure of which is hereby incorporated by reference herein) a method of recovering energy from spent cooking liquors by passing the liquors in heat-exchange relationship with cooler liquors, for example, in a steam generating device referred to as a "reboiler", to produce fresh, uncontaminated steam, is disclosed. This method contrasted with earlier methods of recovering energy from spent liquor by using flash evaporation. Such earlier methods inherently entrained undesirable sulfur-bearing compounds, such as hydrogen sulfide [$H_2S$], methyl mercaptan [$CH_3SH$], dimethyl sulfide [$CH_3SCH_3$], and dimethyl disulfide [$CH_3SSCH_3$] as well as other gases, referred to collectively as Total Reduced Sulfur gases or TRS gases. When such steam generated by the flashing of spent cooking liquors was used to pretreat wood chips, the undesirable TRS gases introduced an additional treatment load on the Non-Condensable Gas (NCG) collection system, if present, or introduced the risk of releasing such undesirable, malodorous compounds to the environment.

Published PCT application WO 97/29236 discloses various methods for recovering and utilizing the heat of spent cooking liquor. These include the use of liquor-liquor heat exchangers, reflux boilers and evaporators. However, though this PCT application discloses a process that is similar to the process disclosed in WO 96/32531 in which a source of "clean" steam is provided, this PCT application does not disclose nor suggest the use of a process according to the present invention.

The present invention represents an improvement to the invention in WO 96/32531 by decreasing the temperature of the steam that can be produced by the reboiler or other steam generating device so that more energy in the form of heat can be recovered from the spent cooking liquor and re-used in and around the pulp mill.

In its broadest embodiment the present invention comprises or consists of a method and apparatus for increasing the energy efficiency of a cellulose digester heat recovery system by: (a) introducing a slurry of comminuted cellulosic fibrous material and liquid to a treatment vessel to produce cellulose pulp; (b) treating the material in the vessel with treatment chemical at a temperature greater than 140° C. and a pressure greater than 5 bar gage to produce a treated material and a spent treatment liquor, including sulphur compounds; (c) removing the spent treatment liquid from the vessel at a first temperature; (d) passing the spent liquor in indirect heat exchange relationship with a cooler liquid having a second temperature lower than the first temperature to produce steam (e.g. substantially clean steam) at a first pressure, and at a third temperature higher than the second temperature; (e) increasing the pressure of the steam produced to a second pressure higher (i.e. at least 10% higher and/or by at least about 0.2 bar gage and/or to at least 0.2 bar gage) than the first pressure; and (f) using the steam at the second pressure as needed in the digester system.

In the practice of the method set forth above, (e) may be practiced using a fan or compressor, or an eductor (also known as an ejector) wherein steam at a pressure of between about 3 and 13 bar gage is added to the steam from (d) in the eductor to increase the pressure of the steam from (d). When (e) is practiced so that the second pressure is at least 0.2 bar gage (e.g. 0.4 bar gage or more), (e) is also preferably practiced so that the temperature of the steam is at least 105° C. (e.g. 105–109° C. or more), and then (f) may be practiced to steam comminuted cellulose material being introduced into a feed system for the treatment vessel. In another aspect, (d) may be practiced by introducing as the cooler liquid an essentially sulfur-free liquid, or "clean" liquid, for example, essentially clean water, such that the steam produced is essentially clean steam, for example, containing little or no sulfur compounds. In a further embodiment of this invention, the above invention includes an additional step (g), during step (d), of producing a cooler spent cooking liquor from the spent liquor and using at least some of this cooler spent cooking liquor as the source of cooler liquid in step (d).

Also in the practice of the above method, the spent liquor removed in (c) is typically black liquor at about 140–160° C., and the method further comprises (h) passing the black liquor into indirect heat exchange relationship with a third liquid to recover some of the heat from the black liquor in the third liquid prior to the practice of (d). Typically this is achieved by passing the hot black liquor in heat exchange relationship with one or more liquids in one or more heat exchangers. Typically (d) is practiced using a steam generating device, for example a reboiler; and may further comprise positively cooling the spent liquor after it passes through the steam generating device. Again, this positive cooling may be effected by passing the liquor in heat exchange relationship with one or more liquids in one or more heat exchangers after the practice of (d).

In a preferred embodiment, the positive cooling of the spent liquor after the steam generating device is effected by passing the spent liquor in indirect heat exchange relationship with a fourth liquid to reduce the spent liquor temperature below the prevailing boiling temperature of the liquor (typically around 100° C.) so that the spent liquid may be stored in an unpressurized state, for example, in an unpressurized storage tank, prior to further treatment.

According to another aspect of the invention a method of producing steam having less noncondensible gases than steam produced by flashing black liquor, including sulphur compounds, directly into steam, in a digester system, is provided. The method comprises: (a) Passing hot black liquor, including sulphur compounds, at a temperature of about 120–165° C. from a digester through a heat exchanger. (b) Passing an evaporable liquid to be evaporated through the heat exchanger into heat exchange contact with the hot black liquor so that the evaporable liquid is heated so that it is ultimately evaporated to produce steam having less condensable gases than steam produced by flashing black liquor, including sulphur compounds, directly into steam. (c)

Increasing the pressure of steam from (b) by at least 0.2 bar gage. And, (d) using the steam from (c) in the digester system.

In this method, preferably the evaporable liquid used in (b) is substantially free of sulphur compounds; and (b) is practiced to produce substantially clean steam. Step (c) may be practiced using an eductor, fan, or compressor, as described above, and to produce substantially clean steam at a pressure of at least 0.2 bar gage and a temperature of at least 105° C. The method may also comprise (e) passing the hot black liquor into indirect heat exchange relationship with another liquid to recover some of the heat from the black liquor in the other liquid prior to the practice of (b). In a preferred embodiment the noncondensible gases that are reduced are preferably one or more Total Reduced Sulfur (TRS) gases, as described above.

According to another aspect of the present invention there is provided a digester system comprising: A digester having a hot spent treatment liquor outlet. A feed system for feeding comminuted cellulose material to the digester. A steam generating device operatively connected to the spent treatment liquor outlet to use the heat of the spent treatment liquor to produce steam from another liquid, the steam generating device having a steam outlet and a spent treatment liquor outlet. A pressure increasing device, connected to the steam outlet, which increases the pressure of the steam from the steam generating device. And, a utilization device operatively connected to the pressure utilization device to utilize the steam therefrom.

In the digester system the pressure increasing device may be a fan, compressor, or eductor. The system may also comprise an indirect heat exchanger connected between the spent treatment liquor outlet and the steam generating device for recovery of some of the heat from the hot spent treatment liquor before that liquor is passed to the steam generating device; and a flow control valve between the pressure increasing device and the utilization device controlled by feedback from the utilization device, in which case preferably the utilization device comprises the feed system (e.g. a chip bin therein).

It is the primary object of the present invention to provide enhanced recovery and effective use of energy from spent cooking liquor during chemical pulping. This and other objects of the invention will become clear from an inspection of the detailed description of the invention, and from the appended claims.

DETAILED DESCRIPTION OF THE DRAWINGS

Figure 1:
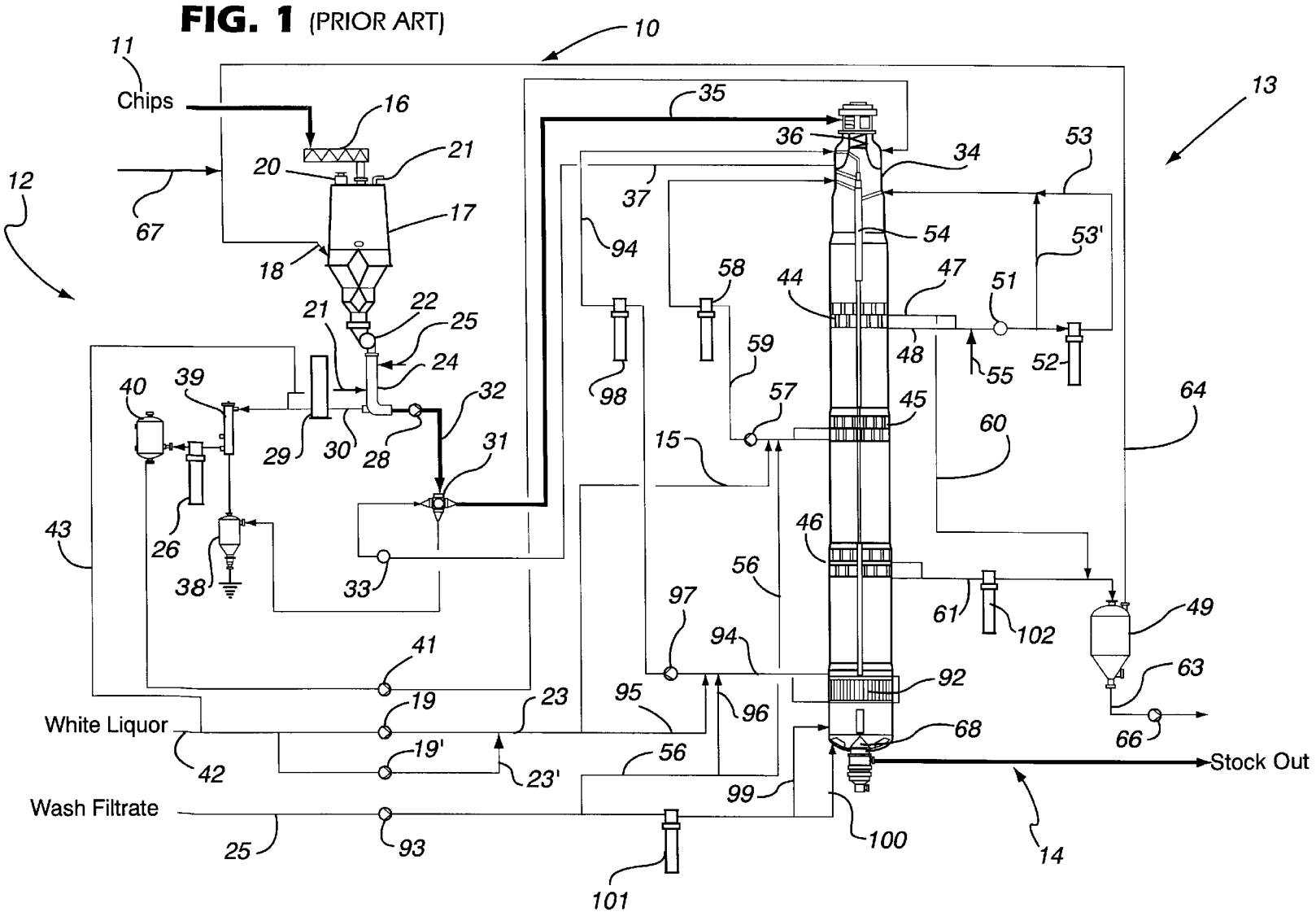
FIG. 1 (PRIOR ART)
FIG. 1 schematically illustrates a typical prior art cellulose pulp treatment system over which the present invention is an improvement.

FIG. 1 illustrates a prior art system 10 for treating comminuted cellulosic fibrous material, for example wood chips, 11 over which the present invention is an improvement and into which the present invention can be incorporated. System 10 includes a feed system 12 for introducing wood chips 11 and initiating the treatment, and a digester system 13 in which the chips are treated to produce a cellulose pulp 14. Though the system 13 shown is a continuous digester system, it is understood that the present invention can also be implemented in a discontinuous, or batch, digester system.

Though any feeding system can be used to introduce chips to system 10, the system shown, and the preferred system when implementing the present invention, is the system described in U.S. Pat. Nos. 5,476,572; 5,622,598; 5,635,025; 5,736,006; 5,753,075; 5,766,418; and 5,795,438. This feed system is marketed under the trademark Lo-Level® by Ahlstrom Machinery Inc. of Glens Falls, N.Y.

Wood chips 11 are introduced via a conventional conveyor (not shown) for example, to an isolation device 16. The isolation device 16 isolates the feed system from the atmosphere, and may be any type of conventional isolation device, for example, a Chip Gate as sold by Ahlstrom Machinery, but it is preferably a screw conveyor with a weighted hinged gate at its discharge as described in U.S. Pat. No. 5,766,416. The isolation device 16 introduces chips to a retention and steaming vessel 17. Again, though any type of steaming or retention vessel may be used, the preferred vessel 17 is the one described in U.S. Pat. Nos. 5,500,083; 5,617,975; 5,628,873; 4,958,741; and 5,700,355 and marketed under the trademark DIAMONDBACK® by Ahlstrom Machinery. The DIAMONDBACK® steaming vessel is characterized as providing uniform steaming of wood chips while not requiring any form of vibration or agitation at its discharge. This uniform discharge without agitation is effected by using a unique single convergence geometry. Steam is provided to the bin 17 via one or more nozzles 18. As is typical, bin 17 includes one or more conventional gamma-radiation level detectors (not shown), an exhaust vent 20 for collecting gases which can accumulate in the bin 17, and a pressure controlling vent 21.

Bin 17 discharges to a metering device 22, which may be a Chip Meter sold by Ahlstrom Machinery, as shown, or one or more metering screws. The metering device optionally discharges steamed chips to a conventional pressure isolation device such as a star-type pressure isolation device, for example, a Low Pressure Feeder sold by Ahlstrom Machinery, but preferably discharges steamed chips directly to a conduit 24, for example, a Chip Tube or Chip Chute as sold by Ahlstrom Machinery. The fully-steamed and slightly pressurized chips first encounter cooking liquor in conduit 24. The cooking liquor is introduced via one or more conduits 27. This cooking liquor may be any form of sulfate (e.g. white liquor) or sulfite cooking liquor and may contain yield or strength enhancing additives. Steam may also be introduced to conduit 24 via one or more conduits 25. Conduit 24 may also have a gamma-radiation level detection system (not shown) for controlling the level of chips in the conduit 24.

As is characteristic of the LO-LEVEL® feed system 12, as described in the above U.S. patents, conduit 24 introduces a slurry of chips and liquor to the inlet of a slurry pump 28. The slurry pump 28 may typically be a HIDROSTAL pump as sold by Wemco of Salt Lake City, Utah, though other equivalent pumps may be used. Additional liquid may be supplied to the inlet of the pump 28 from liquor tank 29 and conduit 30. Pump 28 passes the chip slurry to the low pressure inlet of high-pressure transfer device 31 via conduit 32. Device 31 is typically a high-pressure feeder as sold by Ahlstrom Machinery, though any type of transfer device can be used. The high-pressure feeder 31 includes a pocketed rotor which receives a slurry of chips from conduit 32 and via rotation exposes the slurry to a flow of high pressure liquid provided by pump 33, known in the art as a Top Circulation Pump. The slurry is pressurized to 5–10 bar and transported to the top of vessel 34, the digester, via conduit 35. Excess liquor introduced to digester 34 via conduit 35 is separated using a separating device 36, for example, a Top Separator, and returned to the feed system 12 by conduit 37 to supply the liquid pressurized by pump 33.

Feed system 12 also utilizes conventional equipment typically included in such systems, including a Sand Separator 38, an In-line Drainer 39, a Level Tank 40, a Feed Circulation Liquor Cooler 26, and a Make-up Liquor Pump 41, all sold by Ahlstrom Machinery. Cooking chemical, for example, kraft white, green, or black liquor, is typically introduced to the feed system 12 by conduits 42, 43 and 27.

Digester 34 may consist of a single vessel, as shown, or it may comprise multiple a vessels, for example, an impregnation vessel and a digester. Digester 34 typically includes at least two or more annular screen assemblies 44, 45, 46 and 92. Any type of treatment may be preformed in vessel 34, but preferably the treatment comprises or consists of one or more of the processes disclosed in U.S. Pat. Nos. 5,489,363; 5,536,366; 5,547,012; 5,575,890; 5,620,562; and 5,662,775, and marketed under the trademark LO-SOLIDS® by Ahlstrom Machinery.

For example, in FIG. 1, one form of a LO-SOLIDS process is provide by removing liquor from vessel 34 via screen 44 and conduits 47 and 48 and forwarding the liquid in conduit 47 to treatment outside the digester 34, for example, to flash evaporation in flash tank 49 via conduit 60. The liquid removed from screen 44 via conduit 48 may be recirculated via pump 51, heater 52, conduit 53, and a central distribution conduit (a "center-pipe") 54 and reintroduced to the digester 34 in the vicinity of screen 44. Heater 52 may also be bypassed via conduit 53. Cooking liquor or dilution liquor may be introduced to conduit 53 via conduit 55.

Digester 34 also includes a circulation associated with screen 45. Liquor removed via screen 45 is preferably augmented in conduit 59 with cooking liquor and dilution liquor via conduits 15 and 56. Cooking liquor is typically supplied via conduits 42, 23 and 15 and pressurized via white liquor pump 19 or its spare 19'. The dilution liquid 56 is typically supplied via conduits 25 and 56 and pressurized by filtrate pump 93. Though wash filtrate is shown as the source of dilution in FIG. 1, it is understood that any source of low-dissolved-organic-material liquid may be used as diluent.

The augmented liquid in conduit 59 is then pressurized by pump 57 and passed through heat exchanger 58 prior to being reintroduced to the digester 34 in the vicinity of screen 45 via center-pipe 54. Typically, the cooking liquor introduced via conduit 59 and center-pipe 54 passes counter-currently to the flow of wood chips due to the removal of liquid via screen 44 and conduit 47. This counter-current flow of heated cooking liquor also raises the temperature of the slurry between screens 44 and 45 to cooking temperature, that is, to a temperature between about 140 and 180° C. Cooking typically proceeds between screens 45 and 46 such that the liquor removed via screen 46 is approximately at cooking temperature and contains spent cooking chemical and dissolved products of the cooking reaction. In the prior art system shown in FIG. 1, the cooking process progresses below screen 46 in co- or counter-current fashion. For example, in a circulation associated with the lowermost annular screen assembly 93, liquor is removed from the digester 34 via conduit 94, augmented with cooking liquor via conduit 95 and dilution liquor 96, pressurized via pump 97, heated by heater 98 and returned to the vicinity of screen 92 via center-pipe 54.

The cook is terminated with the introduction of dilution liquid, for example, washer filtrate, at one or more locations via conduits 99 and 100 in the lower part of the digester 34. The diluent may be cooled by a cooling heat exchanger 101, for example, a Cold Blow Cooler as provided by Ahlstrom Machinery. The essentially fully-cooked pulp is discharged from the bottom of the digester 34 at a temperature of about 80 to 120° C., typically with the aid of a rotating discharge device 68, into conduit 14 and forwarded to further treatment, for example, brown stock washing.

In typical prior art cooking systems, the hot spent liquor removed via screen 46, typically at between 140–180° C. and 5 to 10 bar gage, is expanded under controlled conditions, that is, "flashed", to remove water vapor and other volatile compounds in the liquor as steam, and to lower the temperature and pressure thereof. In FIG. 1, hot liquor removed by screens 44 and 46 is carried by conduits 60 and 61, respectively to flash tank 49.

The hot liquor in conduit 61, typically at about 140–160° C. and 5–10 bar gage, may be passed through a heat exchanger 102 to heat other liquids. For example, heat exchanger 102 may be a Digester Steam Economizer, as sold by Ahlstrom Machinery, through which the diluent in conduit 56 is passed to heat the diluent prior to introducing it to cooking circulation conduit 59. The liquor in conduit 60, for example, at about 115–125° C., is typically cooler than the liquor in conduit 61 because the liquor in conduit 60 is removed earlier or prior to the chip slurry being heated to cooking temperature. Thus, the combined liquors introduced to flash tank 49 is only about 120 to 140° C.

In flash tank 49 the hot, pressurized liquor is exposed to a lower pressure, for example, a pressure between 0.8 and 1.5 bar gage, so that some of the water in the liquor rapidly evaporates, or "flashes", to steam. This steam, typically at a temperature of about 103 to 113° C. and a pressure of about 0.1 to 0.6 bar gage, is then carried by conduit 64 for use in other parts of the mill. One preferred use of this steam is as the steaming medium in chip bin 17, introduced via conduit 18.

The cooler, lower pressure liquor, typically at a temperature of about 117 to 127° C. and a pressure of about 0.8 to 1.5 bar gage, is discharged from flash tank 49 into conduit 63 and pumped via pump 66 to further processing, for example, to spent liquor filtering device and chemical recovery. The steam in conduit 18 may also be supplemented by fresh steam or steam from other sources via conduit 67.

Since the steam that is discharged in conduit 64 is produced from the direct evaporation of spent (sulphur compound containing) cooking liquor, it contains various amounts of TRS gases, such as hydrogen sulfide [$H_2S$] or methyl mercaptan [$CH_3SH$]. Introducing these sulfur-containing gases to the feed system 12 is undesirable since some accommodation must be made to prevent leakage of these malodorous gases to the environment, for example, by using a dedicated NCG collection system. It is difficult to prevent the release of the TRS gases via isolation devices and air-locks while introducing comminuted cellulosic fibrous material to the feed system 12. For this reason, it is desirable to not produce sulfur-bearing steam streams for re-use in the feed system or anywhere else in the pulp mill.

WO 96/32531 introduced the concept of not flashing the spent cooking liquor, 60,61, but instead using this hot liquor as a heating medium for liquids containing little or no sulfur compounds to produce a substantially sulfur-free steam. That earlier invention used a device referred to as a "reboiler" to pass the reduced-sulfur-containing liquid in heat-exchange relationship with the hot spent cooking liquor. However, that invention is thermodynamically limited by the "clean" steam pressure required. That is, a certain minimum pressure is required in the prior art system that is sufficient for using the steam produced as needed. This minimum pressure thermodynamically limits the temperature of the steam that can be produced and as a result limits the amount of cooling that can be done in the steam generating device, that is, reboiler. The present invention overcomes this disadvantage to provide not only a more efficient way of producing a substantially clean source of steam, but also to permit a more efficient recovery of energy from the hot spent cooking liquor.

Figure 2:
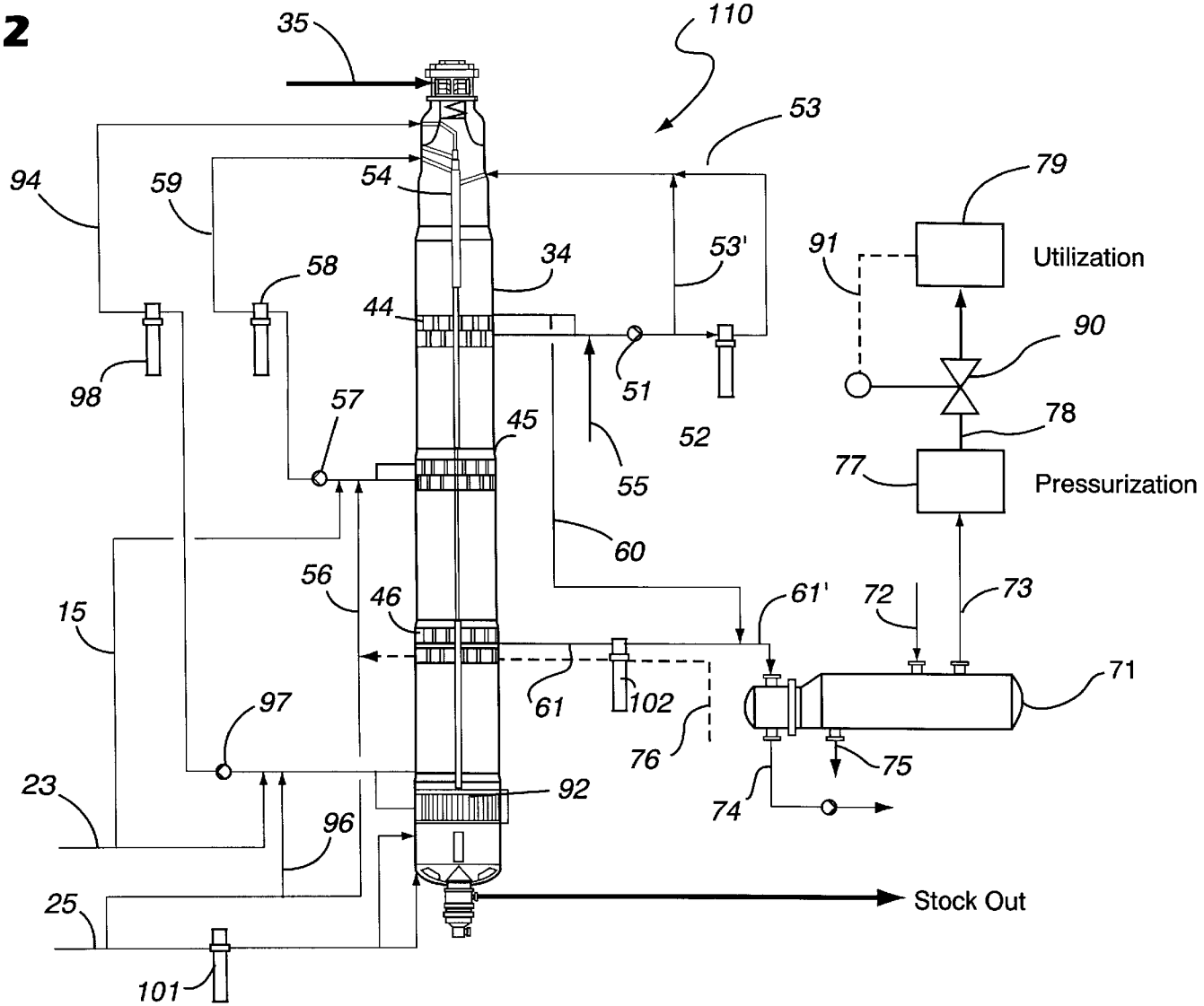
FIG. 2 schematically illustrates a system in which the present invention can be utilized for the digester shown in FIG. 1.

FIG. 2 illustrates one embodiment of a system 110 according to the present invention. System 110 includes a digester 34 and related equipment that is essentially identical to the digester 34 and related equipment shown in FIG. 1 and is labeled with the same reference numerals. In addition FIG. 2 also includes a steam generating device or reboiler 71 that replaces the flash tank 49 of FIG. 1.

Similar to the system disclosed in WO 96/32531, the hot spent liquor in conduit 61, 61', at about 110–170° C., preferably at about 120–150° C., is passed through a heat exchanger 71, specifically a kettle-type reboiler, to heat a liquid 72 containing little or no sulfur compounds, to produce a source of steam 73 for use as needed, preferably to steam chips in the feed system 12 of FIG. 1. The liquid in conduit 72 is typically mill water at a temperature of about 60–90° C., preferably about 70–80° C. At the same time, the hot liquor in 61, 61' is cooled and discharged to conduit 74, at about 80–120° C., preferably about 90–110° C., and forwarded to further treatment, for example, to a conventional fiber filtering device and then to a heat and chemical recovery system. The liquor in conduit 74 can be forwarded to one or more additional heat exchangers, for example, a Black Liquor Cooler 74' as sold by Ahlstrom Machinery, to further cool the liquor, to about 80–100° C., and recover heat from it. However, if the reboiler 71 is sufficiently large enough, substantially all cooling for heat recovery can be effected in the reboiler 71 and no further cooling is necessary. This can be particularly effective when a reduced volume of steam, or no steam, is required in the feed system 12, for example, no steaming is done in chip bin 17. Heated excess hot non-sulfur-containing liquid is discharged into conduit 75 and used as needed in the pulp mill.

In a preferred embodiment, the hot liquor 61 may also be passed in heat exchange relationship with other liquids in one or more heat exchangers 102 before the liquor is passed to reboiler 71. The number of heat exchangers used depends upon the desired pressure and volume of the steam produced by the reboiler 71, the capacity of the one or more heat exchangers 102, and the temperature of the hot spent liquor 61, among other things. The preferred medium heated in heat exchanger 102 is dilution filtrate introduced to one or more Lo-Solids® cooking circulation associated with digester 34. For example, dilution liquor, such a washer filtrate, evaporator or heat exchanger condensate, or clean water, is preferably passed in conduit 76, heated in heat exchanger 102, for example, a Digester Steam Economizer as sold by Ahlstrom Machinery, and introduced to the Lo-Solids cooking circulation 59 via conduit 56. In a preferred embodiment, only the hotter liquor removed from screens 46, at about 140–160° C., is passed through heat exchanger 70. The cooler spent liquor in conduit 60, at a temperature of about 100–130° C., preferably about 110–120° C., bypasses the heat exchanger 102 and is introduced to conduit 61' downstream of heat exchanger 102. In this way, only the hottest spent cooking liquor is used as a heating medium in heat exchanger 102. The present invention is not limited to mixing the liquor streams 60 and 61, but can also be applied to either stream alone. For example, only the hotter liquor in conduit 61, with or without passing through heat exchanger 102, may be passed to reboiler 71 to perfect the present invention.

According to the present invention the relatively clean steam 73 produced by reboiler 71 is pressured by a pressurization device 77 prior to being transferred via conduit 78 to the consumer or utilization device 79 of the steam. The pressure of the steam sent to device 79 is controlled by a pressure control valve 90 which receives a pressure control signal via loop 91 from the device 79 utilizing the steam. Utilization device 79 may be a digester feed system 12 (e.g. chip bin 17) as shown in FIG. 1, or may be any other device in which a pressurized source of clean steam can be used. By pressurizing the steam in conduit 73 using device 77, the steam produced by reboiler 71 may be produced at a lower pressure. Allowing the reboiler 71 to produce steam 73 at a lower pressure thermodynamically allows the lower pressure steam to be produced at a lower temperature. Allowing the steam 73 to be produced at a lower temperature, allows the temperature of the cooled spent liquor 74 to be lower and the temperature of the hot excess substantially sulfur-free liquid 75 to be hotter.

For example, in the prior art system of WO 96/32531, without the pressurization of steam 73 via device 77, the pressure of the steam produced by reboiler 71 has to be great enough to supply the consumer 79 of the steam. For example, if the steam is used in the feed system 12 of the digester 34, the steam must have a pressure of at least approximately 0.2 to 0.4 bar gage. This thermodynamically requires that the temperature of steam 73 be at least about 105–109° C. This minimum temperature of the steam limits the temperature of the cooled hot spent liquor 74 to about 106–114° C., depending upon the economics of the installation and the size of the reboiler 71, among other things. The temperature of the hot sulfur-free liquid 75 is also cooled to approximately the same temperature of the steam 73, that is, 105–109° C. Liquid 75 may not be removed continuously, but may be discharged intermittently as needed (this is referred to as "blow down") to control the concentration of dissolved material present in the liquid in the reboiler. However, by introducing a pressurization step/device 77, the minimum pressure of the steam 73 is substantially unlimited and may even be a vacuum. Thus, this lower pressure thermodynamically allows the temperature of steam 73 to have a substantially unlimited lower temperature. Furthermore, this permits the temperature of the liquid in conduit 74 to be lower and the temperature of the liquid in conduit 75 to be lower than in the system 10 of FIG. 1.

Figure 3:
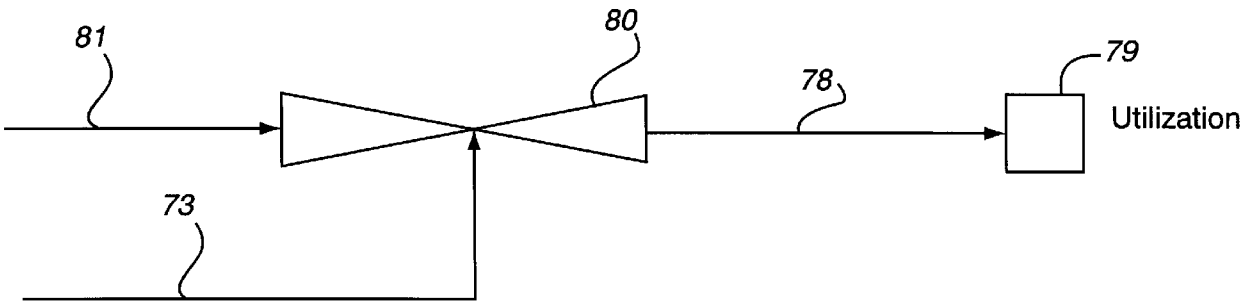
FIGS. 3 and 4 schematically illustrate two preferred embodiments of the pressurizing device and procedure part of the present invention.
Figure 4:
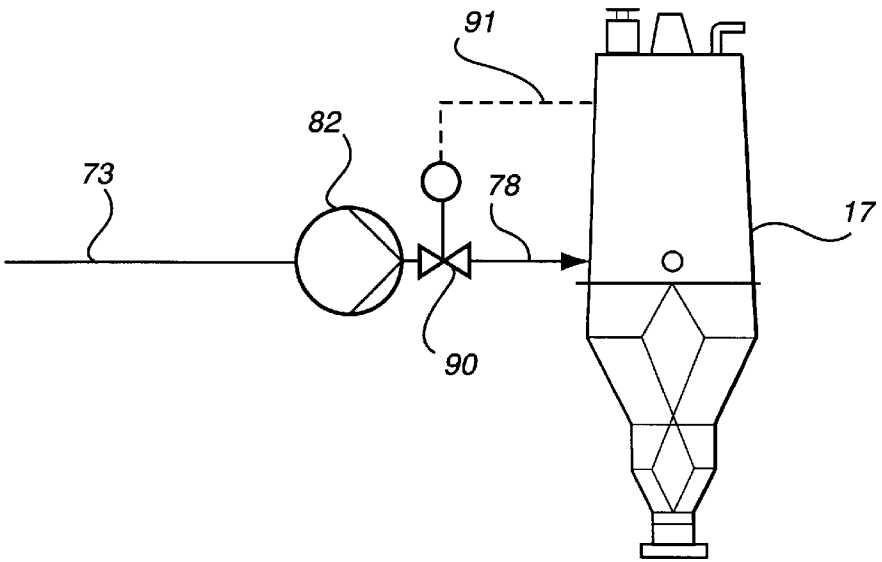

FIGS. 3 and 4 schematically illustrate two specific embodiments of the pressurization step of the invention. FIG. 3 illustrates the use of an eductor 80 as the pressurization device 77 of FIG. 2. In this embodiment, the steam in conduit 73 from reboiler 71 of FIG. 2 is introduced to the eductor 80 and mixed with the gas from a gas supply 81 at a higher pressure than the steam in conduit 73 (e.g. at least 10% higher). The resultant steam, at a higher pressure, is discharged from the eductor 80 to conduit 78 and passes to the utilization device 79 (for example, chip bin 17 of FIG. 1). Gas supply 81 is preferably another steam supply, for example, a steam supply having a pressure between about 9 and 13 bar gage. One preferred source of steam 81 is medium pressure steam readily available in the pulp mill.

FIG. 4 illustrates another embodiment of the invention in which the pressurization device 77 of FIG. 2 is a compressor or fan 82. Compressor or fan 82 pressurizes the steam in conduit 73 so that it can be used in, for example, Chip Tube 24 of FIG. 1, or—as shown—chip bin 17.

Other conventional pressurization devices aside from eductors, fans, and compressors may be used as the device 77.

Data exemplary of the energy and temperature levels that can be expected in the digester system 110 of FIG. 2 when utilizing the eductor 80 embodiment of FIG. 3 are shown in Table 1. In contrast, the energy and temperature levels of a typical prior art system without an eductor 80 are shown in Table 2.

TABLE 1

Temperatures and pressures for a system producing pulp at kappa number of 25 according to the present invention. Assumes that the amount steam 81 introduced to the eductor 80, equals the amount of steam generated by the reboiler 73 and a 98% eductor efficiency.

| Description | Item Ref. No. | Temperature [° C.] | Pressure [Bars, gage] |
|---|---|---|---|
| Spent Liquor Extracted from Digester | 61 | 162.6 | |
| Spent Liquor Introduced to Reboiler After Heat Exchanger | 61' | 131.0 | |
| Hot Water Introduced to Reboiler | 72 | 75.0 | |
| Hot Water Removed from Reboiler | 75 | 93.5 | |
| Cooled Black Liquor from Reboiler | 74 | 95.0 | |
| Steam Generated by Reboiler | 73 | 93.5 | −.20 to −.10 |
| Steam Introduced to Eductor | 81 | 200.0 | 13 |
| Steam to Chip Bin | 78/17 | 105.0 | 0.1–0.2 |

TABLE 2

Temperatures and pressures for a system producing pulp at kappa number of 25 according to the prior art.

| Description | Item Ref. No. | Temperature [° C.] | Pressure [Bars, gage] |
|---|---|---|---|
| Spent Liquor Extracted from Digester | 61 | 162.6 | |
| Spent Liquor Introduced to Reboiler After Heat Exchanger | 61' | 131.0 | |
| Hot Water Introduced to Reboiler | 72 | 75.0 | |
| Hot Water Removed from Reboiler | 75 | 112.0 | |
| Cooled Black Liquor from Reboiler | 74 | 112.0 | |
| Steam Generated by Reboiler and Introduced to Chip Bin | 73 | 110.0 | 0.2–0.4 |

Comparison of the data in Tables 1 and 2 clearly shows that the temperature of the steam produced in the reboiler 71 of the present invention (that is, 93.5° C.) is 16.5° C. degrees cooler than the temperature of steam the steam produced by the prior art reboiler (that is, 110° C.). The pressure of the steam produced by the reboiler 71 of the present invention (that is, about −0.2 bar gage) is about 0.5 bars less than the pressure produced by the prior art reboiler (that is, about 0.3 bars gage). This permits the temperature of the cooled black liquor from the reboiler 71 of the present invention (that is, about 95° C.) to be about 17° C. cooler than the prior art cooled spent liquor temperature (that is, about 112° C.). The temperature of the hot water produced in the reboiler 71 according to the present invention (that is, about 93.5° C.) is about 18.5° C. cooler than the hot water produced by the prior art system 10 (that is, about 112° C.). Thus, according to the present invention much more energy can be recovered from hot spent cooking liquor, and re-used, than can be recovered from the prior art system 10.

It is to be understood that the data shown in Table 1 is representative of one set of conditions under which the present invention can be operated. These conditions will vary depending upon the economics, the related equipment and its operating conditions, etc. of the mill. For example, the reboiler 71 may also be operated at higher pressures (e.g., at 0.2 bar gage or higher) and higher temperatures (e.g., at 105° C. or higher) and still be used to effect the present invention. Also, the temperatures of the liquids flowing to and from the reboiler 71 may vary. For example, depending upon the size and type of the reboiler 71 or other heat exchanger used, the temperature of the cooler black liquor 74 may approach the temperature of the steam 73 produced. Other operating conditions will be apparent to those of skill in the art.

Thus, according to the present invention a method and apparatus for minimizing the escape of malodorous, TRS-laden, gases from the feed system of a cellulose material treatment system while recovering as much energy as possible from spent treatment liquor used in the system, is provided. The present invention requires less energy than prior art systems since the only energy leaving the system leaves with the pulp 14, the spent cooking liquor 74, and the steam (including recoverable turpentine) 20 (in FIG. 1). Furthermore, all of these heat-containing streams leave this system at the temperature desired for the next downstream operation, that is, no heating or cooling of these streams is necessary for further treatment according to the present invention.

In the above description, the invention also encompasses all possible narrower ranges within any broad range.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of producing chemical cellulose pulp in an energy efficient manner using a treatment vessel in a digester system, comprising:

(a) introducing a slurry of comminuted cellulosic fibrous material and liquid to a treatment vessel to produce cellulose pulp;

(b) treating the material in the vessel with treatment chemical at a temperature greater than 140° C. and a pressure greater than 5 bar gage to produce a treated material and a spent treatment liquor, including sulphur compounds;

(c) removing the spent treatment liquid from the vessel at a first temperature;

(d) passing the spent liquor in indirect heat exchange relationship with a cooler liquor having a second temperature lower than the first temperature to produce steam at a first pressure, and at a third temperature higher than the second temperature;

(e) increasing the pressure of the steam to a second pressure by at least about 0.2 bar more than the first pressure; and (f) using the steam at the second pressure in the digester system.

2. A method as recited in claim 1 wherein (e) is practiced using an eductor.

3. A method as recited in claim 2 wherein steam at a pressure of between about 9 and 13 bar gage is added to the steam from (d) in the eductor to increase the pressure of the steam from (d).

4. A method as recited in claim 1 wherein (e) is practiced using a fan or compressor.

5. A method as recited in claim 1 wherein (e) is practiced so that the second pressure is at least 0.2 bar gage, and so that the steam is at a temperature of at least 105° C.

6. A method as recited in claim 5 wherein (d) is practiced to produce substantially clean steam, and wherein (f) is practiced to steam comminuted cellulose material being introduced into a feed system for the treatment vessel.

7. A method as recited in claim 1 wherein the liquor removed in (c) is black liquor at a temperature of between about 140–160° C.; and further comprising, after (c), (g) passing the black liquor into indirect heat exchange relationship with a third liquid to recover some of the heat from the black liquor in the third liquid prior to the practice of (d).

8. A method as recited in claim 1 wherein (d) is practiced using a steam generator; and further comprising positively cooling the spent liquor after it passes through the steam generator.

9. A method of producing steam having less noncondensible gases than steam produced by flashing black liquor, including sulphur compounds, directly into steam, in a digester system, comprising:

(a) passing hot black liquor, including sulphur compounds, at a temperature of about 120–165° C. from a digester through a heat exchanger;

(b) passing an evaporable liquid to be evaporated through the heat exchanger into heat exchange contact with the hot black liquor so that the evaporable liquid is heated so that it is ultimately evaporated to produce steam having less noncondensible gases than steam produced by flashing black liquor, including sulphur compounds, directly into steam;

(c) increasing the pressure of steam from (b) by at least 0.2 bar gage; and (d) using the steam from (c) in the digester system.

10. A method as recited in claim 9 wherein the evaporable liquid used is (b) is substantially free of sulphur compounds; and wherein (b) is practiced to produce substantially clean steam.

11. A method as recited in claim 10 wherein (c) is practiced to produce substantially clean steam at a pressure of at least 0.2 bar gage and a temperature of at least 105° C.

12. A method as recited in claim 11 where (d) is practiced to steam comminuted cellulose material prior to introduction thereof into the digester.

13. A method as recited in claim 10 further comprising (e) passing the hot black liquor into indirect heat exchange relationship with another liquid to recover some of the heat from the black liquor in the other liquid prior to the practice of (b).

14. A method as recited in claim 9 wherein (c) is practiced using an eductor, and introducing steam at a pressure of between about 3 and 13 bar gage with the steam from (b) into the eductor.

15. A digester system comprising:

a digester having a hot spent treatment liquor outlet;

a feed system for feeding comminuted cellulose material to said digester;

a steam generator operatively connected to said spent treatment liquor outlet to use the heat of the spent treatment liquor to produce steam from another liquid, said steam generator having a steam outlet and a spent treatment liquor outlet;

a pressure increasing device, connected to said steam generator steaming outlet, which increases the pressure of the steam from said steam generator; and a utilization device operatively connected to said pressure increasing device to utilize the steam therefrom.

16. A digester system as recited in claim 15 wherein said pressure increasing device comprises a fan or compressor.

17. A digester system as recited in claim 15 wherein said pressure increasing device comprises an eductor.

18. A digester system as recited in claim 15 further comprising an indirect heat exchanger connected between said spent treatment liquor outlet and said steam generator for recovery of some of the heat from the hot spent treatment liquor before that liquor is passed to said steam generator.

19. A digester system as recited in claim 15 further comprising a flow control valve between said pressure increasing device and said utilization device controlled by feedback from said utilization device.

20. A digester system as recited in claim 19 wherein said utilization device comprises said feed system.

* * * * *